United States Patent [19]

Turner et al.

[11] Patent Number: 4,557,207

[45] Date of Patent: Dec. 10, 1985

[54] METHOD AND APPARATUS FOR IMPROVED AUTOMATIC STITCHING

[75] Inventors: Vernon S. Turner, Arvada; Randall Melton, Brighton, both of Colo.

[73] Assignee: Melco Industries, Inc., Denver, Colo.

[21] Appl. No.: 579,310

[22] Filed: Feb. 13, 1984

[51] Int. Cl.[4] ..... D05B 21/00

[52] U.S. Cl. ..... 112/266.1; 112/454; 112/121.12

[58] Field of Search ..... 112/121.12, 158 E, 121.11, 112/266.1, 262.1, 454, 453

[56] References Cited

U.S. PATENT DOCUMENTS

| | | | |
|---|---|---|---|
| 4,086,862 | 5/1978 | Makabe et al. | 112/158 |
| 4,092,938 | 6/1978 | Coughenour et al. | 112/158 |
| 4,142,473 | 3/1979 | Itoh | 112/158 |
| 4,280,424 | 7/1981 | Carbonato et al. | 112/158 |
| 4,309,950 | 1/1982 | Franklin | 112/121.12 X |
| 4,325,315 | 4/1982 | Totino et al. | 112/158 |
| 4,326,473 | 4/1982 | Kigawa | 112/158 |
| 4,352,334 | 10/1982 | Childs et al. | 112/266.1 |
| 4,365,565 | 12/1982 | Kawai et al. | 112/103 |
| 4,369,722 | 1/1983 | Nishida et al. | 112/103 |
| 4,381,721 | 5/1983 | Makabe et al. | 112/158 |
| 4,389,954 | 6/1983 | Makabe et al. | 112/158 |
| 4,413,574 | 11/1983 | Hirota et al. | 112/121.12 |

*Primary Examiner*—Peter Nerbun

*Attorney, Agent, or Firm*—Sheridan, Ross & McIntosh

[57] ABSTRACT

A method and apparatus are provided for operator-controlled stitching of letters on materials wherein the letters have common stitch parameters. The operator selects desired stitch parameters, such as letter height, letter width, and stitch density, and stores the parameters in memory. In using the stored stitch parameters, the operator recalls them using a keyboard and also selects letters which are to be stitched using the stored and recalled stitch parameters. The apparatus is able to apply or use the recalled stitch parameters in connection with the selected letters to stitch the letters. In addition, the operator is able to define a number of different stitch patterns having selected and stored letters which can later be recalled for stitching thereof.

5 Claims, 15 Drawing Figures

Microfiche Appendix Included
(2 Microfiche, 100 Pages)

| KEYS | DISPLAY | |
|---|---|---|
| PROGRAM | PROGRAM ? | |
| 2 | PROGRAM 2 | |
| ENTER | PROGRAM TWO | 000 |
| STYLE | STYLE | 001 |
| 1 | 1 | 002 |
| RETURN | RETURN | 003 |
| ENTER LETTERS | ENTER LETTERS | 004 |
| CAPS | | |
| S | S | 005 |
| O | O | 006 |
| F | F | 007 |
| T | T | 008 |
| B | B | 009 |
| A | A | 010 |
| L | L | 011 |
| L | L | 012 |
| RUN | RUN | 013 |
| STYLE | STYLE | 014 |
| 2 | 2 | 015 |
| RETURN | RETURN | 016 |
| ENTER LETTERS | ENTER LETTERS | 017 |
| T | T | 018 |
| E | E | 019 |
| A | A | 020 |
| M | M | 021 |
| RUN | RUN | 022 |
| STYLE | STYLE | 023 |
| 3 | 3 | 024 |
| RETURN | RETURN | 025 |
| RUN | RUN | 026 |
| PROGRAM | END OF FUNCTION | 027 |

Fig 6A.

Fig. 6B.

| | |
|---|---|
| ENTER LETTERS | ENTER LETTERING |
| CAPS | |
| SAM | SAM |
| $ | SAM $ |
| TOM | SAM $ TOM |
| $ | SAM $ TOM $ |
| JOE | SAM $ TOM $ JOE |
| WRITE | END OF FUNCTION |

STYLE 1 → Softball

STYLE 3 → SUPER

STYLE 2 → Fan

Fig. 3A.

STYLE 1:

| STATUS KEY | ARC/LINE KEY |
|---|---|
| SCRIPT ALPHABET | ARC FROM CENTER |
| LETTERING MODE | $\phi$ DEGREES |
| HEIGHT: 0.50 IN. | CLOCKWISE |
| DENSITY: 54/IN. | RADIUS 2.55 IN. |
| LENGTH: 0.16 IN. | |

STYLE 2:

| STATUS KEY | ARC/LINE KEY |
|---|---|
| ROMAN BLOCK | ARC FROM CENTER |
| LETTERING MODE | 180 DEGREES |
| HEIGHT: 0.50 IN. | COUNTERCLOCKWISE |
| DENSITY: 54/IN. | RADIUS 2.05 IN. |
| LENGTH: 0.16 IN. | |

STYLE 3:

| STATUS KEY | ARC/LINE KEY | H/V/L SPACE KEY |
|---|---|---|
| BLOCK | LINE CENTER MIDDLE | V SPACE -0.45 IN. |
| LETTERING MODE | | |
| HEIGHT: 0.50 IN. | | |
| DENSITY: 54/IN. | | |
| LENGTH: 0.16 IN. | | |

fig. 3B.

Fig. 3C.

KEYSTROKE ENTRIES:

STYLE
1
RETURN
ENTER LETTERS
TYPE IN:
SOFTBALL
RUN
START

STYLE
2
RETURN
ENTER LETTERS
TYPE IN:
FAN
RUN
START

STYLE
3
RETURN
ENTER LETTERS
TYPE IN:
SUPER
RUN
START

Fig. 3D.

RECALL A STYLE:

| KEYS | DISPLAY |
|---|---|
| STYLE | STYLE ? |
| 3 | STYLE 3 |
| RETURN | END OF FUNCTION |

RUN A STYLE:

| | |
|---|---|
| ENTER LETTERS | ENTER LETTERS |
| TYPE IN THE LETTERS YOU WANT SEWN. | LETTERS WILL APPEAR AS YOU ENTER THEM |
| RUN | SEW (NAME OF BOARD) |
| START | |

SOFTBALL
SAM
TEAM
STYLE 1
STYLE 3
STYLE 2

SOFTBALL
TOM
TEAM
STYLE 1
STYLE 3.
STYLE 2

SOFTBALL
JOE
TEAM
STYLE 1
STYLE 3
STYLE 2

SOFTBALL
Jack
Team
STYLE 1
STYLE 3
STYLE 2

STYLE 1:

| STATUS KEY | ARC/LINE KEY |
|---|---|
| KNIT BLOCK | ARC FROM CENTER |
| LETTERING MODE | 0 DEGREES |
| HEIGHT: 0.30 IN. | CLOCKWISE. |
| DENSITY: 45/IN. | RADIUS 1.20 IN. |
| LENGTH: 0.16 IN. | |

STYLE 2:

| STATUS KEY | ARC/LINE KEY |
|---|---|
| JOINT SCRIPT | ARC FROM CENTER |
| LETTERING MODE | 180 DEGREES |
| HEIGHT: 0.25 IN. | COUNTERCLOCKWISE |
| DENSITY: 45/IN. | RADIUS 1.20 IN. |
| LENGTH: 0.16 IN. | |

STYLE 3:

| STATUS KEY | ARC/LINE KEY |
|---|---|
| BRUSH SCRIPT | LINE CENTER. |
| LETTERING MODE | |
| HEIGHT: 0.37 IN. | |
| DENSITY: 50/IN. | |
| LENGTH: 0.16 IN. | |

Fig. 4B.

Fig 4C.

| KEYS | DISPLAY |
|---|---|
| PROGRAM | PROGRAM ? |
| 1 | PROGRAM 1 |
| ENTER | PROGRAM ONE 000 |
| STYLE | STYLE 001 |
| 1 | 1 002 |
| RETURN | RETURN 003 |
| ENTER LETTERS | ENTER LETTERS 004 |
| S | S 005 |
| O | o 006 |
| F | f 007 |
| T | t 008 |
| B | b 009 |
| A | a 010 |
| L | l 011 |
| L | l 012 |
| RUN | RUN 013 |
| STYLE | STYLE 014 |
| 2 | 2 015 |
| RETURN | RETURN 016 |
| ENTER LETTERS | ENTER LETTERS 017 |
| T | T 018 |
| E | e 019 |
| A | a 020 |
| M | m 021 |
| RUN | RUN 022 |
| STYLE | STYLE 023 |
| 3 | 3 024 |
| RETURN | RETURN 025 |
| ENTER LETTERS | ENTER LETTERS 026 |
| J | J 027 |
| A | A 028 |
| C | C 029 |
| K | K 030 |
| RUN | RUN 031 |
| PROGRAM | END OF FUNCTION |

Fig. 4D.

RECALL A PROGRAM :

| KEYS | DISPLAY |
|---|---|
| PROGRAM | PROGRAM ? |
| 1 | PROGRAM 1 |
| RUN | PROCESSING<br>------ 00:00:00 |

PRESS START KEY AFTER STITCH COUNT BEGINS HERE

RUN TIME

| | |
|---|---|
| START | END OF FUNCTION<br>1000 00:01:00 |

STITCH COUNT AND RUN TIME ADVANCE AS APPARATUS STITCHES.

END OF FUNCTION
4538 00:06:47

FINAL RUN TIME AND STITCH COUNT

METHOD AND APPARATUS FOR IMPROVED AUTOMATIC STITCHING

File has microfiche appendix consisting of two fiche covering 100 frames.

FIELD OF THE INVENTION

The present invention relates to method and apparatus for stitching characters using the same stitch parameters.

BACKGROUND INFORMATION

In automated systems for stitching characters or letters on materials, such as clothing, various advances have taken place to increase the efficiency of the stitching operation. For example, it is known to select a letter to be stitched along with a number of stitch parameters to define the appearance of the letter on the stitched material. The stitch parameters include, for example, letter height, letter width, stitch density, stitch length, and horizontal and vertical spacing between letters. See U.S. Pat. No. 4,352,334 to Childs et al. However, previously devised stitching apparatus have not provided the operator with the capability of storing predetermined stitch parameters and then subsequently recalling them for use with a number of letters to be stitched.

Generally, the present invention provides the operator with the capability of stitching a number of letters having the same desired stitch parameters, without requiring the operator to input the same stitch parameters through a keyboard each time another letter or letters is selected for stitching. Instead, the operator is able to input and afterwards recall the desired stitch parameters and apply them to selected letters. In a further aspect of the present invention, the operator is able to store different stitch parameters and letters to repetitively stitch letters having common stitch parameters as many times as desired.

DISCUSSION OF RELATED PRIOR ART PATENTS

In conjunction with the provisions of 37 C.F.R. 1.97–1.99, the following patents are discussed.

U.S. Pat. No. 4,092,938 to Coughenour et al. discloses a sewing machine with a memory which can be reprogrammed by an operator through a keyboard to provide stitch patterns of the operator's own choosing. The entire pattern to be stitched is programmed into the memory. In contrast, the present invention permits operator inputting of stitch parameters which are recalled from memory and after recall used with inputted characters to repetitively stitch characters having a common stitch pattern.

U.S. Pat. No. 4,280,424 to Carbonato et al. describes a sewing machine having previously stored stitch patterns. An operator is able to modify the storage stitch patterns using keyboard keys. In contrast, the present invention permits the operator to define or input his own stitch parameters and later recall the stitch parameters for use in connection with selected letters.

U.S. Pat. No. 4,352,334 to Childs et al. discloses a stitching apparatus in which one or more letters are selected to be stitched together with inputted stitch parameters. Unlike the present invention, the inputted stitch parameters are not stored for recall to provide a repeated stitching using common stitch parameters.

U.S. Pat. No. 4,086,862 to Makabe et al. relates to a sewing machine and method wherein stitch parameters previously stored in memory can be automatically, repetitively stitched.

U.S. Pat. No. 4,142,473 also provides an electronically controlled sewing machine having stored stitch patterns which can be automatically, repetitively stitched.

U.S. Pat. Nos. 4,381,721 and 4,389,954 to Makabe et al. describe an electronic sewing machine in which stored stitch patterns are selected and a memory keeps track of the combination of different stitch patterns in a predetermined sequence.

U.S. Pat. No. 4,325,315 to Totino et al. relates to a method of monogramming in which stored letters are selected for stitching.

U.S. Pat. No. 4,326,473 to Kigawa also provides for memory means in a sewing system in which stitch patterns are stored.

U.S. Pat. No. 4,365,565 to Kawai et al. discusses the use of programmed patterns and the ability to automatically, repetitively stitch the same.

U.S. Pat. No. 4,369,722 to Nishida et al. relates to a plurality of embroidery sewing machines controlled by a main controller. Embroidery patterns stored in memory may be stitched using the sewing machines.

DISCLOSURE OF THE INVENTION

A stitching apparatus is provided in which an operator is able to generate patterns which are to be repetitively stitched. The apparatus includes a microprocessor for controlling stitching operation and peripheral hardware operably connected to the microprocessor for use in stitching a desired stitch pattern on a work piece or other material. The peripheral hardware includes a keyboard through which an operator inputs information to the microprocessor, a display unit which provides an indication of necessary information associated with the generation of desired stitch patterns, a carriage assembly which supports the work piece and moves to desired locations beneath a threaded needle, and stepping motors activated by the microprocessor for powering the carriage assembly. The apparatus also includes storage memory for storing the executable instructions associated with stitching operation, and also working memory which is able to temporarily store information associated with stitch patterns, which is accessed by the microprocessor during the stitching operation. Significant to proper operation of the present invention, the apparatus also includes style memory and program memory for storing data or information which defines certain aspects or characteristics of stitch patterns. The style memory includes a number of memory locations in which stitch parameters selected by the operator may be stored, after being inputted by the operator through the keyboard to the working memory. The program memory includes a number of memory locations for storing letters selected by the operator, in addition to storing information for identifying selected styles, the stitch parameters of which are stored in the style memory.

In operation, the operator is able to recall a previously stored style from memory, select letters using the keyboard, and initiate stitching of the selected letters according to the stitch parameters which comprise the style recalled from memory. Further, in connection with the program memory, the operator is able to recall the operator-generated program and initiate the stitching thereof. Additionally, the operator has the capability of generating a program having letters which are common to two or more stitch patterns to be stitched, and also letters which are different among the two or more stitch patterns to be stitched.

In view of the foregoing, the present invention achieves a number of worthwhile objectives. An apparatus is disclosed wherein the operator is able to generate desired stitch patterns for repeated stitching. Such a feature reduces operator intervention in connection with the generation of the stitch patterns since common stitch parameters and/or letters can be stored and recalled by the operator. Relatedly, operator error is minimized because of the reduced need for operator inputting to the apparatus. Further related, the apparatus is able to stitch the same or very similar stitch patterns in a fraction of the time previously required because of the reduced operator intervention in connection with repeated stitch patterns.

Additional advantages of the present invention will become more readily apparent from the following discussion, when taken in conjunction with the accompanying drawings.

BRIEF DESCRIPTION OF THE DRAWINGS

FIG. 3A illustrates a stitch design using the Style feature of the present invention;

FIG. 3B illustrates stitch parameters associated with the stitch design of FIG. 3A;

FIG. 3C illustrates keystroke entries associated with the Style for the stitch design of FIG. 3A;

FIG. 3D illustrates the recalling of a Style using the keyboard keys;

FIG. 4B illustrates stitch parameters associated with the stitch design of FIG. 4A;

FIG. 4C illustrates keystroke entries associated with the stitch design of FIG. 4A;

FIG. 4D illustrates the recalling of a Program using the keyboard keys;

FIGS. 6A–6B illustrate keystroke entries associated with the stitch designs of FIGS. 5A–5C.

DESCRIPTION OF THE PREFERRED EMBODIMENT

In accordance with the present invention an apparatus is provided to permit operator generation, through an apparatus keyboard, of one or more stitching patterns, which are to be repetitively stitched on material(s), and wherein working memory and storage memory are utilized.

The apparatus includes hardware disclosed in U.S. Pat. No. 4,352,334 which is assigned to the same assignee as of the present invention. The disclosure of U.S. Pat. No. 4,352,334 is incorporated herein by reference.

Figure 1:
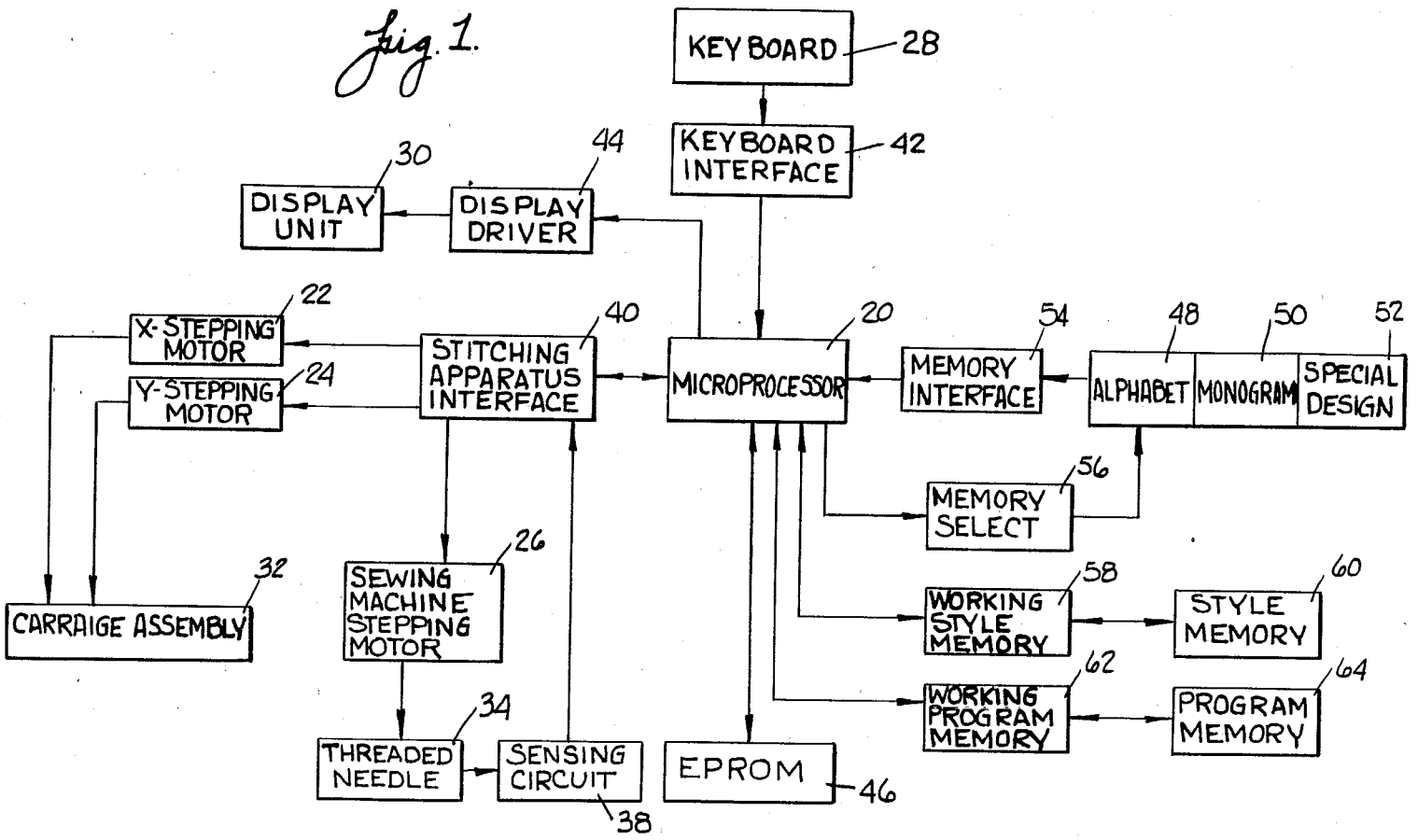
FIG. 1 is a block diagram illustrating the present invention.

With reference to FIG. 1, the apparatus includes a microprocessor 20 used to control the operation of the apparatus. The microprocessor 20 communicates with a number of peripheral devices including a x-stepping motor 22, a y-stepping motor 24, a sewing machine stepping motor 26, a keyboard 28, and a display unit 30.

The x-stepping motor 22 and y-stepping motor 24 are operably connected to a carriage assembly 32. The microprocessor 20 controls the supplying of power to the motors 22, 24 and is thereby able to control movement of the carriage assembly 32. The carriage assembly 32 has a work piece or material to be stitched joined thereto so that the material moves with the carriage assembly 32. Carriage assembly 32 is movable relative to a threaded needle 34 so that the material to be stitched can be positioned at a desired location beneath the needle 34. When the material is at a desired location, the material is stitched using the needle 34. The carriage assembly 32 and material move when the needle 34 is not in the material to be stitched.

The stepping motor 26 is used to provide the vertical or up-down movement of the needle 34. A sensing circuit 38 is provided to monitor the position of the threaded needle 34 and outputs a signal to the microprocessor 20 when the threaded needle is out of the material being stitched so that the microprocessor 20 can initiate energization of the x-stepping motor 22 and the y-stepping motor 24 when required. A stitching apparatus interface 40 couples the stepping motors 22, 24, the sewing machine motor 26, and the sensing circuit 38 to the microprocessor 20. The stitching apparatus interface 40 is a conventional I/O interface for receiving and transferring control signals, including signals form the microprocessor 20. The step signals are used to properly drive the stepping motors 22, 24 while a control signal is provided to power the stepping motor 26.

The keyboard 28 communicates with the microprocessor 20 through a conventional keyboard interface 42. The keyboard 28 enables an operator to provide the necessary inputs to the microprocessor 20 in order to generate stitch patterns which can be stored in memory and recalled from memory. The display unit 30 is a liquid crystal display unit driven by a display driver 44, which communicates with the microprocessor 20. The display unit 30 functions in conjunction with the keyboard 28 to enable an operator to input necessary information for generating the programming features of the present invention.

The apparatus also includes an erasible programmable read only memory (EPROM) 46 for storing software which is executed by the microprocessor 20, such software including instructions for carrying out the features of the present invention. The apparatus further includes printed circuit (PC) memory boards comprising an alphabet memory 48, a monogram memory 50, and a special design memory 52. The alphabet memory 48 includes information which defines letters of the English language in various character types, such as block letters, script letters, and old English style letters. The monogram memory 50 includes information which defines letters to be stitched in a stylized manner, such as the initials of a person's name with the middle initial being of comparatively greater size. The special design memory 52 includes information which defines previously designed stitch patterns, and which typically includes non-letter patterns. Memories 48, 50, 52 are coupled to the microprocessor by means of a memory interface 54. A memory select 56 is used in conjunction with operator selection of desired stitching data from the memories 48, 50, or 52.

The apparatus of the present invention additionally includes memory locations important to the operation of the present invention, specifically, memory defined as working style memory 58, style memory 60, working program memory 62, and program memory 64. The working style memory 58 and working program memory 62 include memory locations which are accessed by the microprocessor 20 in carrying out the stitching operation. The style memory 60 and the program memory 64 include memory locations which store pattern information inputted by the operator and received by the working style memory 58 and working program memory 62, respectively. Such information is stored because the operator desires to save it for future use in connection with stitch patterns to be repetitively stitched.

Figure 2:
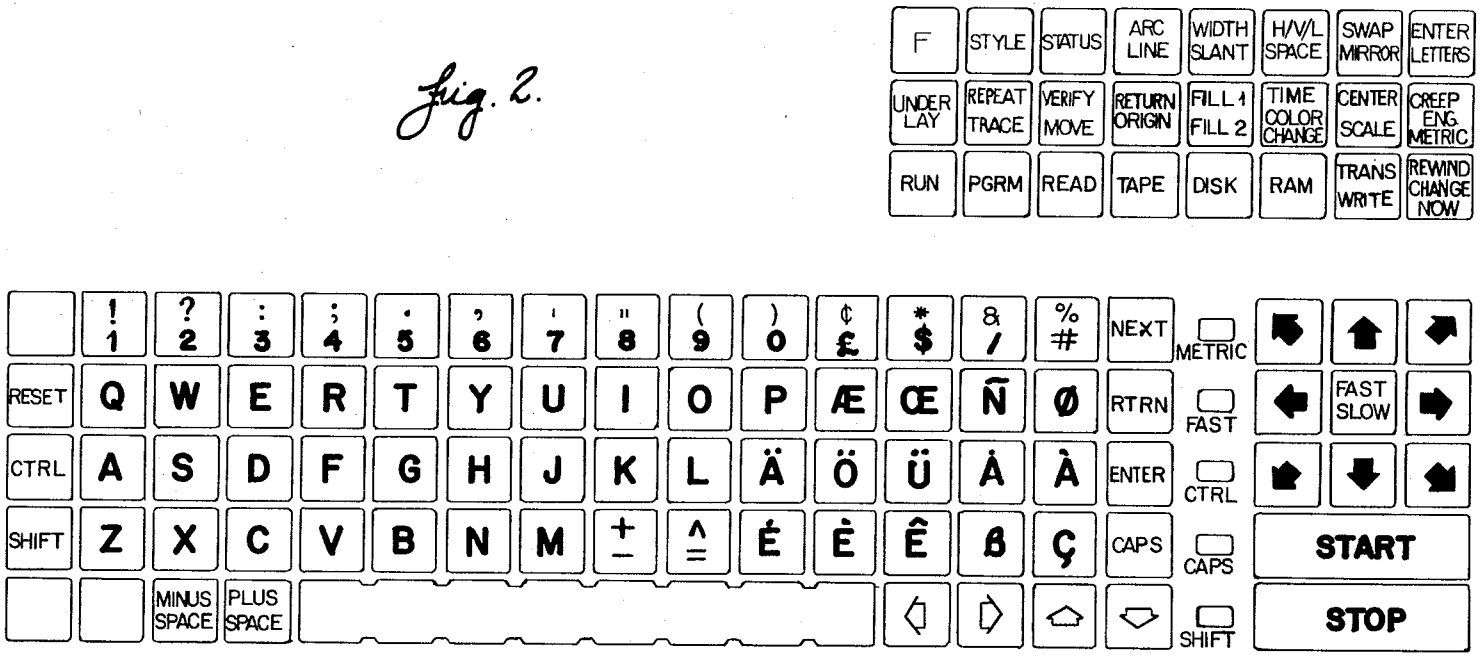
FIG. 2 illustrates keyboard character and function keys associated with the keyboard of the present invention.

Reference is now made to FIG. 2 which illustrates details of the keyboard 28. The keyboard 28 includes a number of keys for operator initiation of the inventive features of the present invention.

The STATUS key of the keyboard 28 is used in selecting one of the three memory boards 48, 50, 52. The display unit 30 provides a visual indication of one of the three memory boards 48, 50, or 52, after the STATUS key is engaged. In order to display an indication of the other two memory boards, the NEXT key of the keyboard 28 is activated or engaged by the operator. When an indication of the memory board 48, 50 or 52 desired to be used is displayed, the operator selects the same by striking the RTRN (return) key. After the desired memory board 48, 50, or 52 is selected, the operator selects a Lettering mode or a Monogram mode, the monogram mode being made available in those instances in which a monogram board 52 is not provided. In those instances in which the alphabet board 48 and Lettering mode are selected, or the monogram board 50 is selected, the display unit 30 is able to sequentially display a number of stitch parameters using the RTRN key. Specifically, after the mode is selected and the RTRN key engaged, the display unit 30 requests that a letter height be inputted through the keyboard 28. Unless the operator inputs a value for letter height, the letter height to be used in the generated stitch pattern will be a default height value previously stored. After the letter height is inputted, or the default height selected, and the RTRN key engaged, in a similar manner, values for stitch density and stitch length can be provided by means of the keyboard 28 character keys.

The ARC/LINE key enables the operator to select one of three line formats or one of two arc formats. When using an arc format, the operator is able to set a reference defined in degrees to center lettering about a desired center. The operator is also able to select the direction of stitching, clockwise or counterclockwise, when using the arc format. Similarly, the operator also selects a radius value. Letters are stitched on the material from the predetermined center according to the magnitude of the radius. As with the STATUS key, the operator uses the ARC/LINE key and the RTRN key in making the desired selections, which are indicated on the display unit 30.

The H/V/L key enables the operator to change the horizontal spacing between selected letters to be stitched, and also enables the operator to modify the vertical spacing between letters, and also enables the operator to vary the magnitude of line spacing when multiple lines are being stitched.

The UNDERLAY key enables the operator to control the density of the stitching so that stitch patterns appear to extend away from the material being stitched.

The REPEAT key enables the operator to stitch multiple copies of the same or essentially the same stitch pattern on a piece of material.

The WIDTH/SLANT key enables the operator to change the column width of letters, and also allows the operator to change the overall width of letters and further permits the operator to slant vertical portions of letters relative to a center point. Like the operation of the STATUS key, the capability of inputting desired values for column width, letter width, and letter slant is achieved using the WIDTH/SLANT key and the RTRN key, together with the selected numbered keys, as the operator observes the proper indications on the display unit 30.

To provide an operator/generated stitch pattern to be repeatedly stitched, reference is made to FIGS. 3A–3D. As previously discussed, operator efficiency is increased and time is saved by the present invention because it permits the operator to store desired stitch parameters which are to be repeated in connection with selected, desired letters. With regard to FIG. 3A, a design having three different "Styles" is illustrated. A "Style" includes a number of desired stitch parameters, which are selected by the operator, and that are used in connection with desired letters. The styles identified as STYLE 1, STYLE 2, and STYLE 3 have been defined, at least in part, by the operator using the aforedescribed STATUS key and ARC/LINE key. In the case of STYLE 1 of FIG. 3A, the operator activates the STATUS key and selects the Script type of lettering, the Lettering Mode, a height of 0.5 inches for each of the letters, a density of 54 stitches per inch, and a stitch length of 0.16 inch. Each of these values is inputted by the operator through the keyboard, as each parameter is indicated on the display unit 30 using the RTRN and/or NEXT keys. Similarly, the operator activates or strikes the ARC/LINE key and selects stitch parameters associated therewith. In particular, using the RTRN key and the keys having the desired magnitudes, the operator is able to select the stitch parameters associated with stitching along an arc so that the stitching is centered about 0° relative to a 0° reference, the stitching runs clockwise, and the distance of the lettering from a predetermined center of the arc is 2.55 inches.

For each stitch parameter selected by the operator, the value thereof is stored at a predetermined location in the working style memory 58. In those instances in which the operator does not input a desired value for a particular stitch parameter, the working style memory 58 includes default stitch parameters. For example, in the case of STYLE 1 of FIG. 3A, the default parameter associated with the "column width" would be used by the apparatus in stitching STYLE 1 since there is no operator input for the column width.

After the desired stitch parameters have been inputted into the working style memory 58, the operator is then able to store those stitch parameters, together with any default stitch parameters located in the working style memory, into a desired style memory 60 storage area. This is accomplished by activating the keyboard key identified as STYLE. Activation of the STYLE key results in the display unit 30 providing an indication of the word "STYLE". The operator selects an identification number for the Style. With regard to FIG. 3C, the Style to be used in connection with the word "SOFT- BALL" is identified as "1". After the operator inputs the number 1, the ENTER key of the keyboard 28 is then activated, which causes a copying of the stitch parameters from working style memory 58 into style memory 60, at memory locations identified as Style 1. The values of the stitch parameters in the working style memory 58 and the values of the stitch parameters of Style 1 in the style memory 60 are now the same.

This same procedure is followed in connection with Style 2 and Style 3, using the stitch parameter selections and values shown in FIG. 3B. The selected parameters for Styles 2 and 3 are, in turn, temporarily stored in the working style memory 58 and copied into the memory locations of the style memory 60 identified as Style 2 and Style 3, respectively. It is also noted that the H/V/L key of the keyboard 28 is utilized in connection with Style 3. Specifically, the value desired in connection with the vertical spacing between the letters for the word "SUPER" is inputted by the operator.

At the completion by the operator of defining Styles 2 and 3 using the desired stitch parameters, the style memory 60 includes information defining three Styles. Each Style comprises values associated with stitch parameters at least some of which have been selected by the operator. Each of the three styles is stored at different locations in the style memory 60. In one embodiment of the present invention, there are ten blocks of memory for storing Styles identified as 0–9. In that embodiment of the invention, the memory location in style memory 60 defined as Style 0 includes default stitch parameters and cannot be written into by the operator. After the three Styles have been stored in the style memory 60, the operator is able to proceed to the next steps of the process. The operator can now recall the stored Styles and apply them to selected letters, which are to be inputted by the operator. Referring to FIG. 3C, the operator activates the STYLE key of the keyboard 28. The display unit 30 indicates that the operator should identify the Style. The operator then inputs the number "1" to identify the Style to be recalled or loaded. The operator then engages the RTRN key of the keyboard 28. The activation of the RTRN key causes copying of the stitch parameters found in the style memory 60 at the memory locations identified as Style 1 into the working style memory 58. The operator also inputs the letters for the word "SOFTBALL", by means of the keyboard 28, into different memory location, since this is the word that is to be stitched using the stitch parameters comprising Style 1. The selection of the letters is accomplished by activation of the "ENTER LETTERS" key and engaging the keys associated with the letters comprising the word "SOFTBALL".

In the preferred embodiment, the operator then activates the keyboard key identified as RUN. The activation of the RUN signals to the microprocessor that the operator has entered all the information needed and the apparatus is ready to stitch the word "SOFTBALL" using the stitch parameters of Style 1, which are now recalled and stored in the working style memory 58. Also, in this embodiment, the operator activates the START key of the keyboard 28 to initiate the actual stitching using hardware and software disclosed in U.S. Pat. No. 4,352,334.

The procedure is followed in connection with stitching the words "SUPER" and "FAN" using style 2 and Style 3 stitch parameters, respectively. That is, the operator initiates the recalling or restoring of the stitch parameters associated with Styles 2 and 3, in turn, from the style memory 60 into the working style memory 58. In connection with each of the recalled styles, the operator activates the ENTER LETTERS key and inputs through the keyboard 28 the letters to be stitched using the stitch parameters of Style 2 and Style 3. The selected letters are separately stored in temporary memory storage space, the contents of which are controlled by the microprocessor 20. After each of the three styles has been recalled and applied to the selected letters, the stitching pattern shown in FIG. 3A results.

In order to repeat the stitching of the same letters or different letters using the same styles, the operator once again recalls the stitch parameters of Style 1 in the manner just discussed, and then inputs the same or different letters which are to be stitched using the selected Style 1. Similarly, Styles 2 and 3 are recalled and letters provided for stitching using the stitch parameters associated therewith. Using this method of the present invention, it is seen that the operator need not enter stitch parameters each time the same letters or different letters are to be stitched using the same stitch parameters. Instead, the operator is able to load the working style memory 58 using the stored styles of the style memory 60 to reduce operator inputting of stitch parameters.

Since it is often desirable to repeat the same letters in stitching desired patterns, as well as the same stitch parameters, the capability of storing and recalling letters is also provided in the present invention using the working program memory 62 and the program memory 64.

To generate a program defining a stitch pattern for repeated stitching, which includes at least one style and one or more letters, the operator first follows the same procedures discussed in connection with development of a style. Specifically, a style number is identified and stitch parameters are selected and stored in the locations of the style memory 60 corresponding to the identified style or styles. After each of the styles is defined, the operator inputs a program identification number. The operator then selects the letters which are to be stitched using the previously defined and stored styles. After the letters are selected and inputted to the working program memory 62, the program is stored in the program memory 64. The developed program can be recalled from the program memory 64 by the operator as desired for repeated stitching of the same pattern. This method is described in more detail with reference to FIGS. 4A–4D. The stitch pattern illustrated in FIG. 4A includes the words "SOFTBALL", "TEAM", and "JACK", each word being stitched using different stitch parameters. Initially, the operator defines each of the three styles associated with each of the three words, the valves of the stitch parameters associated with such styles being shown in FIG. 4B, and stores them in an identified storage area of the style memory 60. After each of the desired styles is stored in the style memory 60, the operator can proceed with the generation of information to be stored in the program memory 64.

Figures 4A, 5A, 5B, 5C:
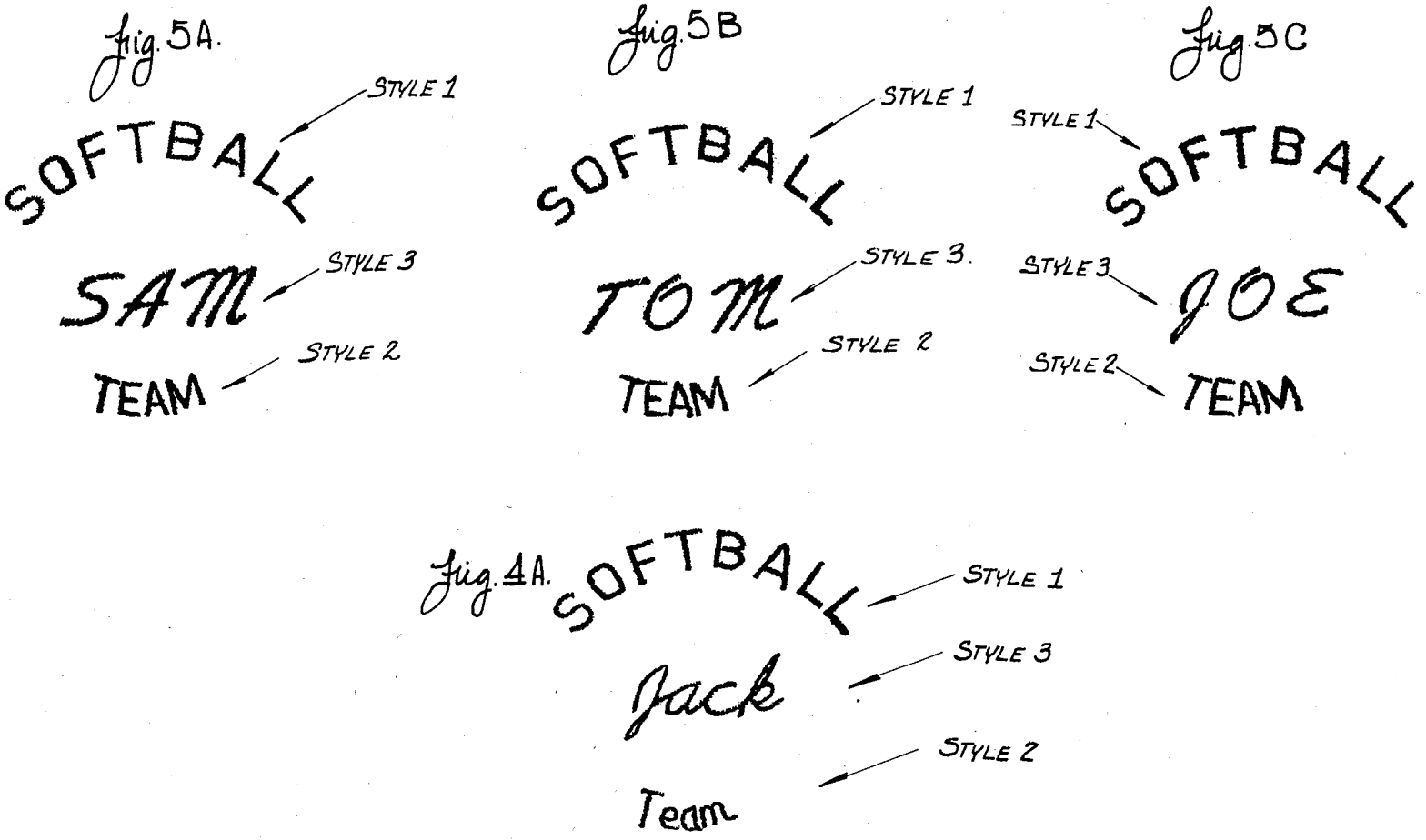
FIG. 4A illustrates a stitch design using the Program feature of the present invention.
FIGS. 5A–5C illustrate additional stitch designs using the repeating Program feature of the present invention.

With reference to FIG. 4C, the operator activates the PGRM (program) key of the keyboard 28. The display unit 30 indicates the word "PROGRAM", and then the operator inputs an identification number for the program. After providing an identification for the program, the operator inputs the information which defines the program. In particular, the identity of each of the styles using the STYLE key is provided by the operator. In connection with each generated style, after activating the ENTER LETTERS key, the operator enters the letters to be stitching using that particular style. With respect to the generation of the program involving the words "SOFTBALL", "TEAM", and "JACK", FIG. 4C illustrates the appropriate keys and the output of the display unit 30 for generating the program for stitching the design as shown in FIG. 4A. The information consisting of the style and letters inputted by the operator using the keyboard 28 is received by the working program memory 62. After the program is completed, the operator copies the contents of the working program memory 62 into the program memory 64 using the PRGM key.

After the program, defined as Program 1, is stored in the program memory 64, the operator is able to stitch the stored pattern as many times as desired by following the procedure illustrated in FIG. 4D. That is, in order to stitch the design illustrated in FIG. 4A, the operator activates the PRGM of the keyboard 28. The display unit 30 indicates that the program identifying number must be inputted. The operator then inputs the program identifying number, in this case, the number 1. The operator then activates the RUN key and the START key of the keyboard 28, see FIG. 4D. In conjunction with the stitching operator, Program 1 is recalled into the working program memory 62. The software of the present invention causes each step of Program 1 to be accessed for proper execution. In that regard, when a step is reached in Program 1 calling for a particular style, such as Style 1, the software causes the identified Style 1 stitching parameters to be recalled from style memory 60 into working style memory 58. In connection with stored letters recalled to the working program memory 62, the software determines that such letters are at the proper location in the working program memory 62, prior to stitching thereof using the Style 1 stitch parameters. To repeat the stitching for the pattern of FIG. 4A, the operator can again proceed through the steps of FIG. 4D. As can be appreciated, the operator does not repeat the inputting of the same letters and stitching parameters.

As also seen in FIG. 4C, in a preferred embodiment, each of the steps of the operator generated program includes an identifying number. This feature, together with accompanying software, enable the operator to access and modify parts of the developed program. For example, it may be desirable to substitute the word "BASEBALL" for the word "SOFTBALL". Additionally, the apparatus includes a timing feature by which the operator is provided with an indication using the display unit 30 of the total number of stitches which make up the generated design. The apparatus also provides an indication to the operator using the display unit 30 as to the total amount of run time taken by the apparatus to stitch the generated design.

In addition to the method by which letter patterns are repeated in their entirety, the present invention also enables the operator to repeat certain portions of a pattern while inputting different letters to complete the design. For example, in the case of a softball team whose members have different names, the present invention permits the operator to stitch clothing using designs having common and uncommon lettering.

With reference to FIGS. 5A–5C and 6A–6B, the operator is able to generate a program including Styles 1 and 2 and letters to be stitched using the generated styles. The program also includes Style 3 in which the letters associated with that style are varied. That is, each time the design is stitched, different letters are stitched in conjunction with Style 3. In the examples shown in FIGS. 5A–5C, a different individual's name is used in each design. The generate the necessary design, the operator generates the program, in the manner discussed in connection with FIG. 4B, shown in FIG. 6A. In particular, a program identifying number is provided (Program 2), the previously defined style identifying numbers are inputted, and in those cases in which the letters remain the same, the letters are inputted with the associated style. In the case in which the letters vary for each design, the present invention provides means for inputting and storing the variable portions or letters of the design. As illustrated in FIG. 6B, the operator activates the ENTER LETTERS key and the display unit 30 provides an acknowledgement of the activation of the key. The operator then inputs the various letters associated with the names "SAM", "TOM", and "JOE". The dollar sign ($) inputted by the operator between each of the three names indicates to the microprocessor 20 that it is to access the next set of letters, after the dollar sign, the next time the design of FIGS. 5A–5C is stitched. When the microprocessor 20 accesses the part of Program 2 associated with Style 3, the software causes the microprocessor 20 to check for the letters stored previously using the ENTER LETTERS key. Upon finding the stored letters, the stitching thereof can be initiated.

In one embodiment, the foregoing method for changing lettering is used in connection with the REPEAT key of the keyboard 28. The operator activates the REPEAT key and informs the apparatus how many copies of the generated design are to be stitched in both a horizontal direction and a vertical direction. The operator also inputs to the apparatus a selected distance between the origins of the designs, in both a horizontal and a vertical direction. After these steps are completed, the operator is able to stitch the designs shown in FIGS. 5A–5C by recalling Program 2 from the program memory 64 to the working program memory 60. When the step associated with Style 3 is reached, the software determines whether the letters are entered constituting the names of the individuals in the memory space reserved for letters entered after activation of the ENTER letter key. When the letters are properly stored, these letters associated with Style 3 can be stitched. In the event that the letters have not been entered, the software informs the operator that the system is waiting for letters to be inputted. As a result of this operation, the operator is able to generate a number of stitch patterns having common and variable letters so that the common letters of the design, as well as the different letters of the design, can be repetitively stitched.

The software associated with the operation of the features of the present invention, including the software for storing into and recalling styles and programs from style memory 60 and program memory 64 using the working memories 58, 62, for applying the stitch parameters of each style to the selected letters, for accessing and modifying programs, and for providing repeated stitch patterns with different letters using the REPEAT key, is provided in the computer print-out identified as Appendix A accompanying this disclosure. A microfiche copy of this appendix is provided. There are 2 microfiche and 100 pages. Based on the foregoing description, a number of advantages of the present invention are readily seen. The apparatus enables an operator thereof to efficiently control the selection of desired stitch patterns, when it is desirable to repeat all or certain portions of a stitch design. These features of the present invention reduce possible operator mistake since operator intervention in connection with repeated stitch patterns is minimized. Concomitantly, operator time expended in inputting information to the apparatus is reduced when stitch patterns are to be repeated since the same stitch parameters and lettering need not be inputted each time the design is to be stitched. Instead, the present invention is able to store and recall information, which can be used with later selected letters to produce desired stitch patterns.

Although the present invention has been described with reference to a preferred embodiment, it is readily understood that variations and modifications can be effected within the spirit and scope of this invention.

What is claimed is:

1. A method of stitching different characters using common stitch parameters based upon operator selection of the desired characters to be stitched and using a keyboard having a number of keys, comprising:

providing a number of style storage areas, each of said style storage areas for receiving a number of different stitch parameters without accompanying characters;

forming a plurality of styles including a first style, each style being defined by a number of stitch parameters;

identifying each of said styles;

storing each of said styles in a different one of said style storage areas and without storing any character in said style storage areas using the identity of each of said styles;

recalling said first style having a number of stitch parameters from said style storage areas;

after forming said first style, selecting a first character to be stitched using the keyboard;

applying said stitch parameters of said recalled first style to said first selected character;

stitching said first selected character using said stitch parameters of said recalled first style;

selecting a second character to be stitched using the keyboard;

applying said stitch parameters of said first style to said second selected character; and stitching said second selected character using said stitch parameters of said first style.

2. A method, as claimed in claim 1, wherein:

said step of storing each of said styles includes locating said number of stitch parameters of said first style in a working style memory and then transferring said number of stitch parameters of said first style to another memory using the identification for said first style to provide relatively permanent storage of said first style.

3. A method of stitching characters, in which the characters have common stitch parameters, based on operator selection of the characters to be stitched and using a keyboard having a number of keys, comprising:

providing a number of style storage areas, each of said style storage areas for receiving a number of different stitch parameters without accompanying characters;

forming a plurality of styles, each style being defined by a number of stitch parameters;

identifying each of said styles;

storing each of said styles in a different one of said style storage areas and without storing any characters in said style storage areas;

providing a number of program storage areas, each of said program storage areas for receiving and storing information relating to at least a first of said styles and for receiving and storing at least a first selected character;

selecting a first character;

forming a first program using said first character and said information relating to said first style;

storing said first program in a first program storage area while keeping said stitch parameters of said first style stored separately from said first character;

accessing said first program storage area;

combining said stitch parameters of said first style with said first character;

stitching said first character using said stitch parameters of said first style; and repeating the stitching of said first character using said stitch parameters of said first style.

4. A method, as claimed in claim 3, wherein:

said step of forming said first program includes locating said first program in a working program memory and then transferring said first program from said working program memory to another memory.

5. An apparatus for stitching characters having common stitch parameters, comprising:

processing means that is controlled using software means;

a keyboard communicating with said processing means and having a number of keys for use in inputting selected characters and selected stitch parameters and for initiating desired stitch-related functions which are controlled using said processing means;

style storage means having a number of different storage areas, each of said style storage areas being identified and each of said style storage areas receiving and storing a number of stitch parameters, said number of stitch parameters being stored in said style storage means without accompanying characters;

said processing means for recalling each of said stitch parameters stored in an identified one of said style storage areas, said processing means combining said selected characters with said stitch parameters stored in said identified one of said style storage areas; and stitching means responsive to said processing means for stitching said selected characters using said stitch parameters of said identified style.

* * * * *

UNITED STATES PATENT AND TRADEMARK OFFICE

CERTIFICATE OF CORRECTION

PATENT NO. : 4,557,207

DATED : December 10, 1985

INVENTOR(S) : Vernon S. Turner and Randall Melton

It is certified that error appears in the above-identified patent and that said Letters Patent is hereby corrected as shown below:

Column 7, line 56, insert "key" between "RUN" and "signals".

Column 7, line 65, insert "foregoing" before "procedure".

Column 7, line 66, delete "style" and substitute therefor --Style--.

Column 8, line 54, delete "valves" and substitute therefor --values--.

Column 9, line 2, delete "stitching" and substitute therefor --stitched--.

Column 9, line 19, insert "key" before --of--.

UNITED STATES PATENT AND TRADEMARK OFFICE

CERTIFICATE OF CORRECTION

PATENT NO. : 4,557,207

DATED : December 10, 1985

INVENTOR(S) : Vernon S. Turner and Randall Melton

It is certified that error appears in the above—identified patent and that said Letters Patent is hereby corrected as shown below:

Column 9, line 25, delete "operator" and substitute therefor --operation--.

Column 9, line 41, delete "stitching" and substitute therefor --stitch--.

Column 10, line 4, delete "The" and substitute therefor --To--.

Column 10, line 66, begin a new paragraph at "Based".

Signed and Sealed this

*Second* Day of *September 1986*

[SEAL]

*Attest:*

DONALD J. QUIGG

*Attesting Officer*

*Commissioner of Patents and Trademarks*